US006739848B1

(12) United States Patent
Hansen et al.

(10) Patent No.: US 6,739,848 B1
(45) Date of Patent: May 25, 2004

(54) HYDRAULIC MOTOR WITH DISC VALVE COMMUTATING SLOTS COMPLIMENTARY IN SHAPE TO PORT PLATE PORTS

(75) Inventors: Kim Rene Hansen, Soenderborg (DK); Claus Johansen, Soenderborg (DK); Rene Andersen, Sydals (DK)

(73) Assignee: Sauer-Danfoss (Nordborg) A/S (DK)

( * ) Notice: Subject to any disclaimer, the term of this patent is extended or adjusted under 35 U.S.C. 154(b) by 0 days.

(21) Appl. No.: 10/339,024

(22) Filed: Jan. 9, 2003

(51) Int. Cl.[7] ..... F03C 2/08
(52) U.S. Cl. ..... 418/61.3; 137/625.21
(58) Field of Search ..... 418/61.3; 137/625.21, 137/625.31

(56) References Cited

U.S. PATENT DOCUMENTS 3,572,983 A * 3/1971 McDermott ..... 418/61.3
4,380,420 A * 4/1983 Wusthof et al. ..... 418/61.3
4,457,677 A * 7/1984 Todd ..... 418/61.3

* cited by examiner

*Primary Examiner*—John J. Vrablik

(57) ABSTRACT

A hydraulic motor of the disc valve type has a disc valve with a plurality of commutation slots that can sequentially register with ports in a port plate as the disc valve is rotated with respect to the port plate. The commutation slots have a geometrical configuration that is complimentary in shape to a portion of the geometric configuration of the ports in the port plate to reduce the resistance to fluid flow through the ports and the slots when the complimentary shapes move into or from superimposed registering positions.

2 Claims, 5 Drawing Sheets

HYDRAULIC MOTOR WITH DISC VALVE COMMUTATING SLOTS COMPLIMENTARY IN SHAPE TO PORT PLATE PORTS

BACKGROUND OF INVENTION

In hydraulic machines of the disc valve type, oil is communicated between inlet/outlet and the gear set through a valve element. This valve element adds an internal resistance against fluid flow, and thus an internal pressure drop.

It is therefore a principal object of this invention to provide a hydraulic motor with disc valve commutating slots complimentary in shape to port plate ports so as to reduce the magnitude of this pressure drop.

A further object of this invention is to provide a hydraulic machine of the disc valve type, where the geometry of the commutating part of the disc valve, in opening and in closing moment, fits with the geometry of the ports of the port plate.

These and other objects will be apparent to those skilled in the art.

SUMMARY OF THE INVENTION

A hydraulic motor of the disc valve type has a disc valve with a plurality of commutation slots that can sequentially register with ports in a port plate as the disc valve is rotated with respect to the port plate. The commutation slots have a geometrical configuration that is complimentary in shape to a portion of the geometric configuration of the ports in the port plate to reduce the resistance to fluid flow through the ports and the slots when the complimentary shapes move into or from superimposed registering positions at opening and closing moments of the ports.

DESCRIPTION OF THE PREFERRED EMBODIMENT

Figure 1:
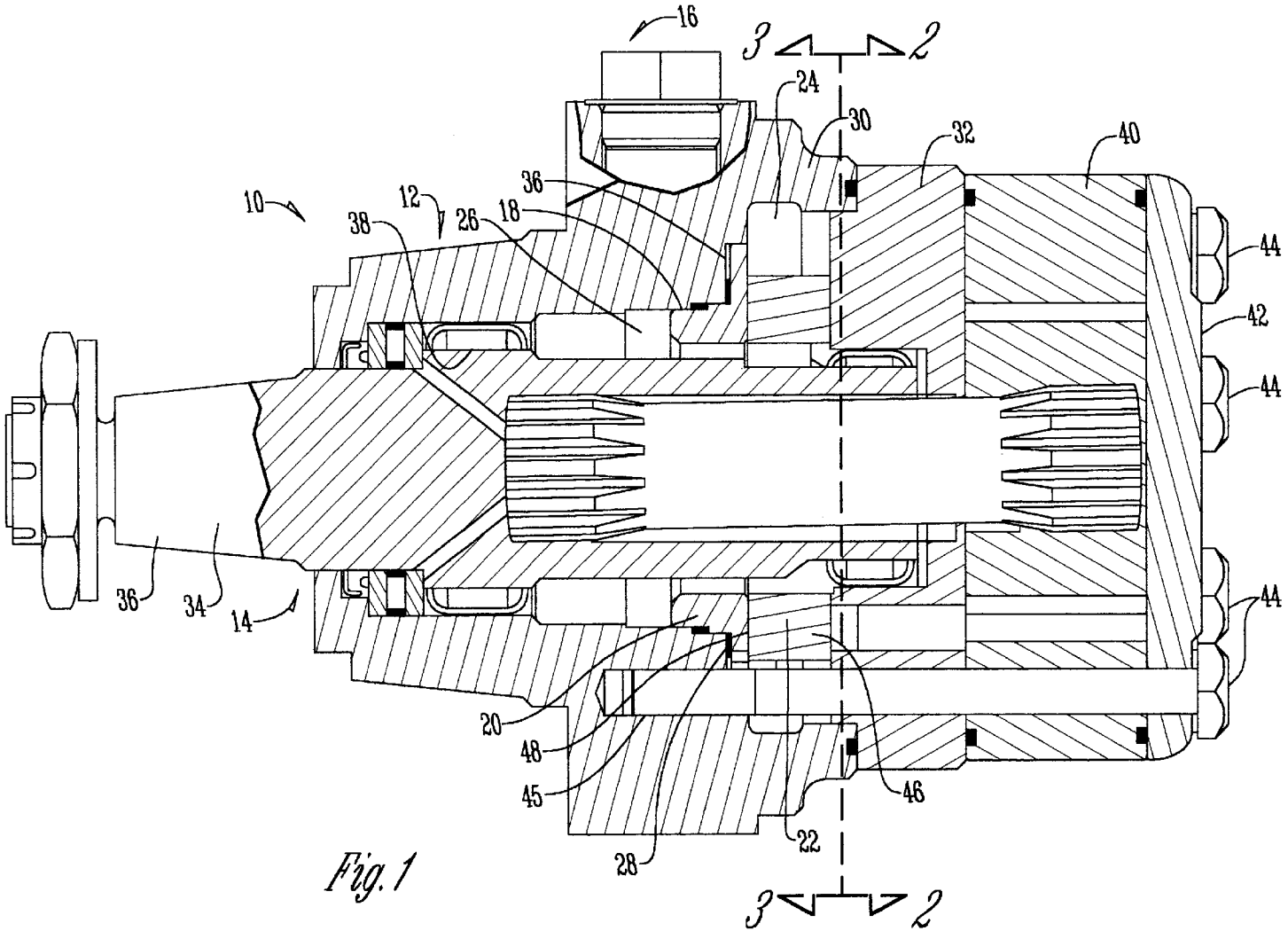
FIG. 1 is a longitudinal sectional view of a hydraulic machine (gerotor motor) using this invention.

FIG. 1 shows a gerotor motor 10 with a housing 12 having a center bore 14. The housing has a typical fluid inlet/outlet port 16. Annular cavity 18 within the housing 12 contains a sealing element 20. A disc valve 22 is located within a first chamber 24. A second chamber 26 accommodates spring 28 which bears against sealing element 20 to hold the sealing element in contact with a forward side 46 of the disc valve 22. A shoulder 30 on the inner end of housing 12 engages port plate 32 (FIG. 1). Shaft 34 with an outer end 36 extends through bearing 38 and inwardly through the center bore 14 of the housing 12 to be connected with splines and the like to gear set 40.

End plate 42 is secured to the rearward end of the motor 10 by a plurality of bolts 44 which extend through the end plate 42, gear set 40, port plate 32 and thence into a threaded well 45 in housing 12. As previously indicated, disc valve 22 has a forward side 46 and a rearward side 48. Commutation slots 50 are formed in the forward side 46 of the disc valve 22 as best shown in FIG. 2.

Figure 2:
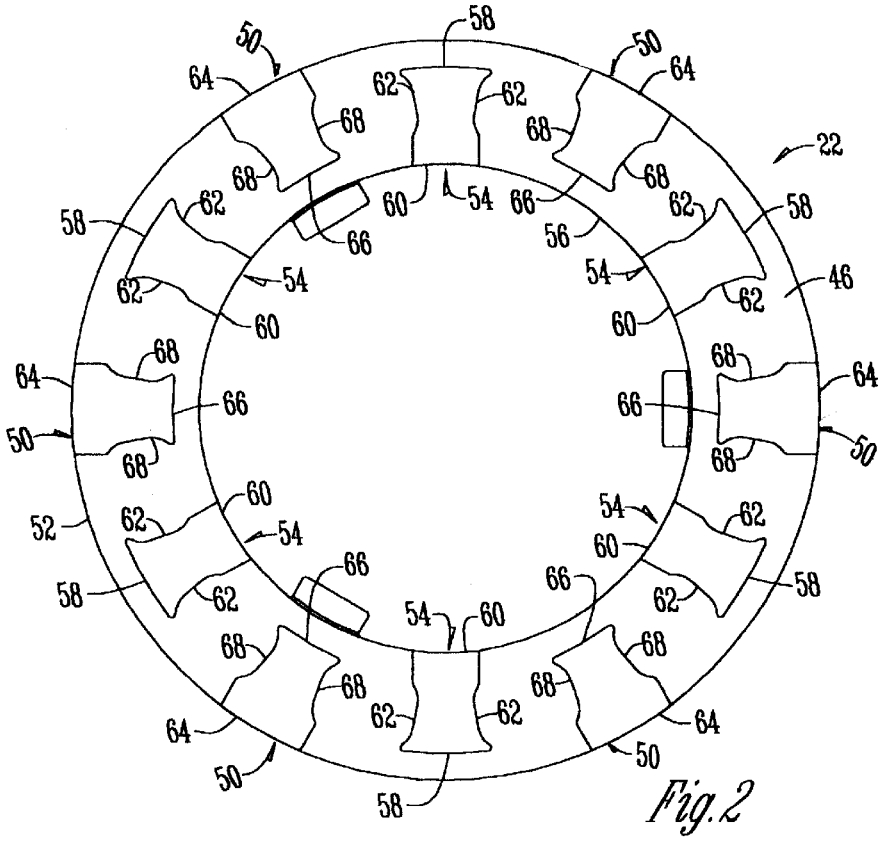
FIG. 2 is a sectional view taken on line 2—2 of FIG. 1.
Figure 7C:
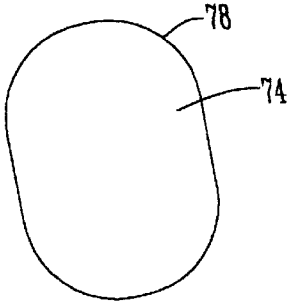
FIG. 7C is an enlarged scale view of the twelve o'clock position on FIG. 3.
Figure 7B:
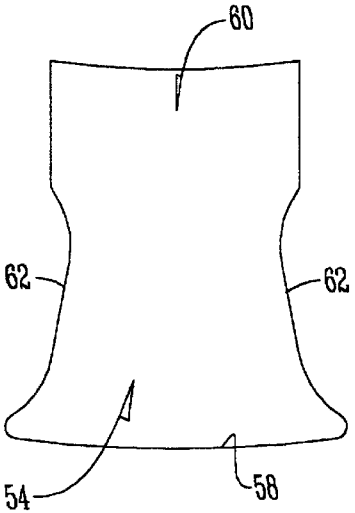
FIG. 7B is an enlarged scale view of the six o'clock position on FIG. 2.

With reference to FIG. 2 the disc valve 22 has a surface 46 having a plurality of external commutating slots 50 that are radially positioned adjacent the outer perimeter 52 of the surface 46. A plurality of internal commutating slots 54 are radially positioned adjacent the inner perimeter 56 of surface 46. The internal slots 54 are uniformly located between the external slots 50. See also FIGS. 7A, 7B and 7C.

Each of the internal slots 54 have a base surface 58, an open end 60 and opposite sides including slightly arcuate portions 62. Each of the external slots 50 have a shape similar to that of slots 54 with the configuration of slots 54 being a mirror image of slots 50. The external slots 50 have open ends 64 and a closed base surface 66, and opposite sides 68 which are the same as the side portions 62 in internal slots 54.

Figure 3:
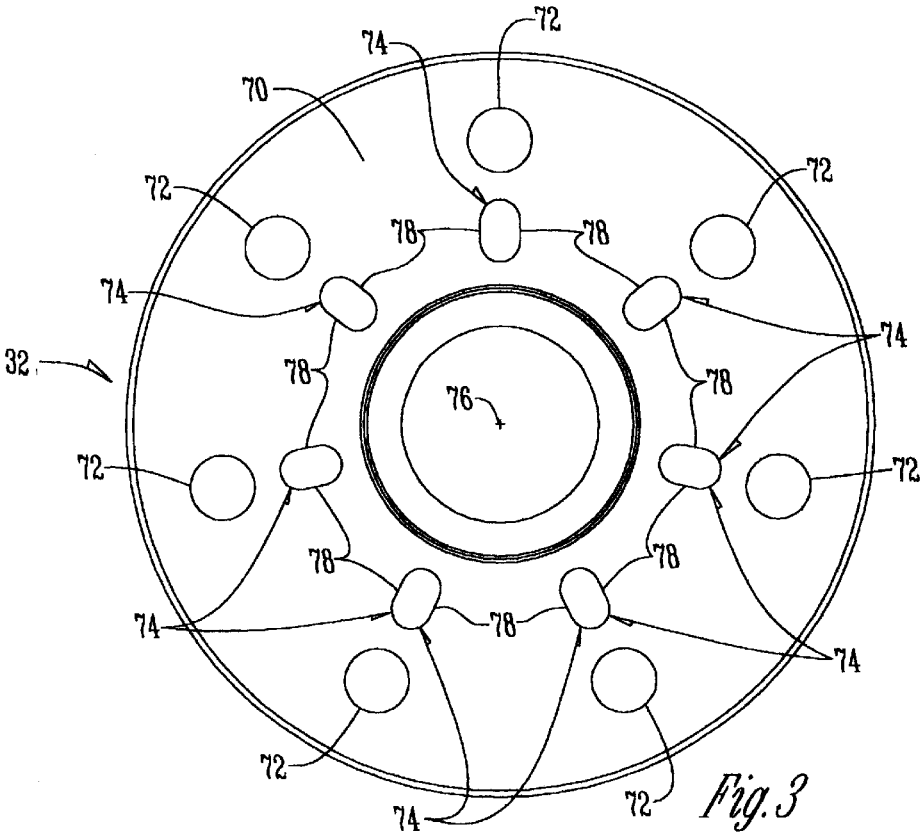
FIG. 3 is a sectional view taken on line 3—3 of FIG. 1.
Figure 5:
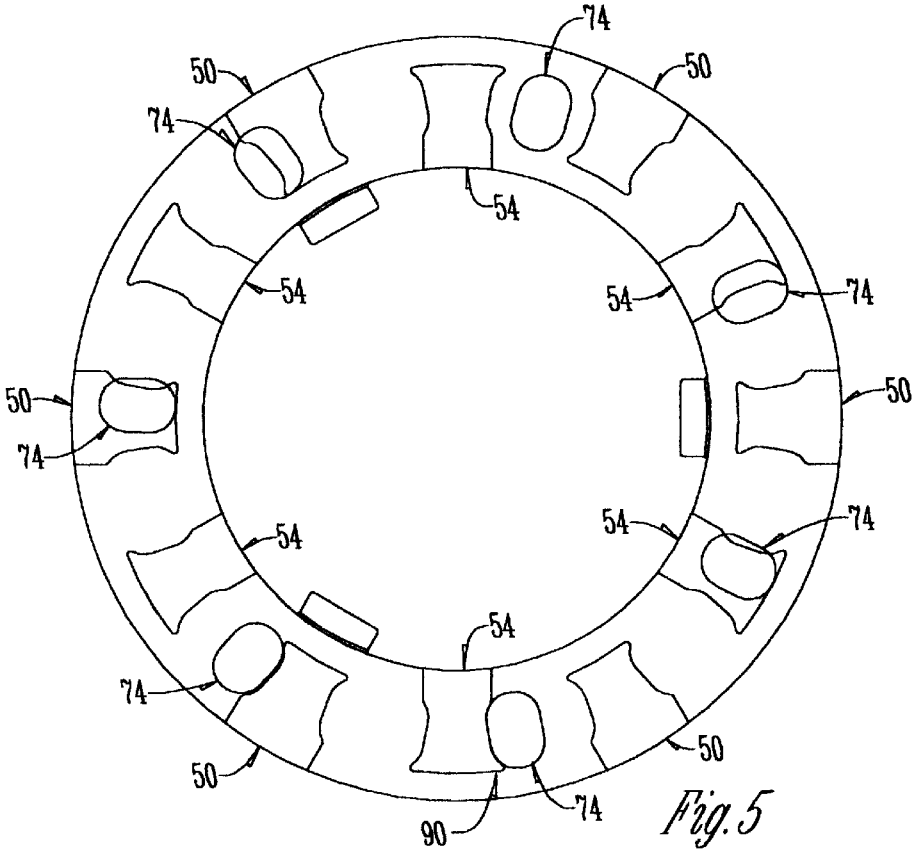
FIG. 5 is a view similar to FIG. 4 but showing the corresponding structure of the invention.
Figure 7A:
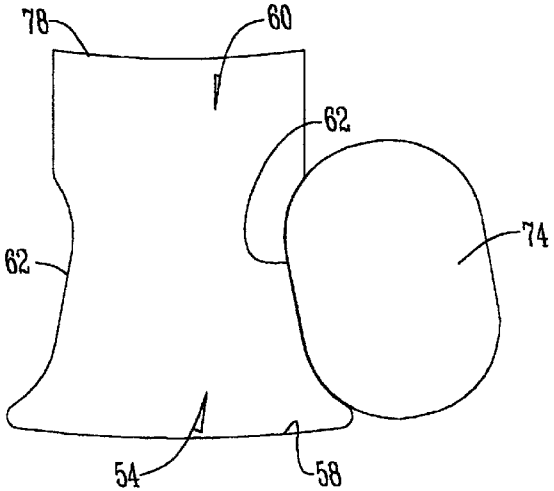
FIG. 7A is an enlarged scale view of the six o'clock position on FIG. 5.

With reference to FIG. 3, a surface 70 of port plate 32 (which interfaces with surface 46 of disc valve 22), has a plurality of spaced bolt holes 72 arranged in a circular pattern. Located in radially inward positions are oval-shaped ports 74 which have a major axis extending radially from the geometric center 76 of the port plate, and a minor axis extending substantially perpendicular to each other. The sides 78 of the ports 74 have an arcuate configuration and are complimentary in shape to sides 62 and 68 of commutation slots 54 and 50, respectively, in the disc valve 22. FIG. 7A illustrates how the sides 78 of a port 74 will nest within the arcuate configuration 62 of slot 54. When the valve plate surface 46 interfaces with surface 70 at port plate 32 at opening and closing moments of the ports 74. The same nesting effect will also take place between ports 74 and the arcuate sides 68 in slots 50. (See this approximate relationship in FIG. 5 at the seven o'clock position of a port 74 and a slot 50).

This nesting effect does not take place in the prior art device (FIG. 4) where the sides of ports 32 are not complimentary in shape to the straight sides 80 of frusto-conically shaped commutation slots 82.

Figure 4:
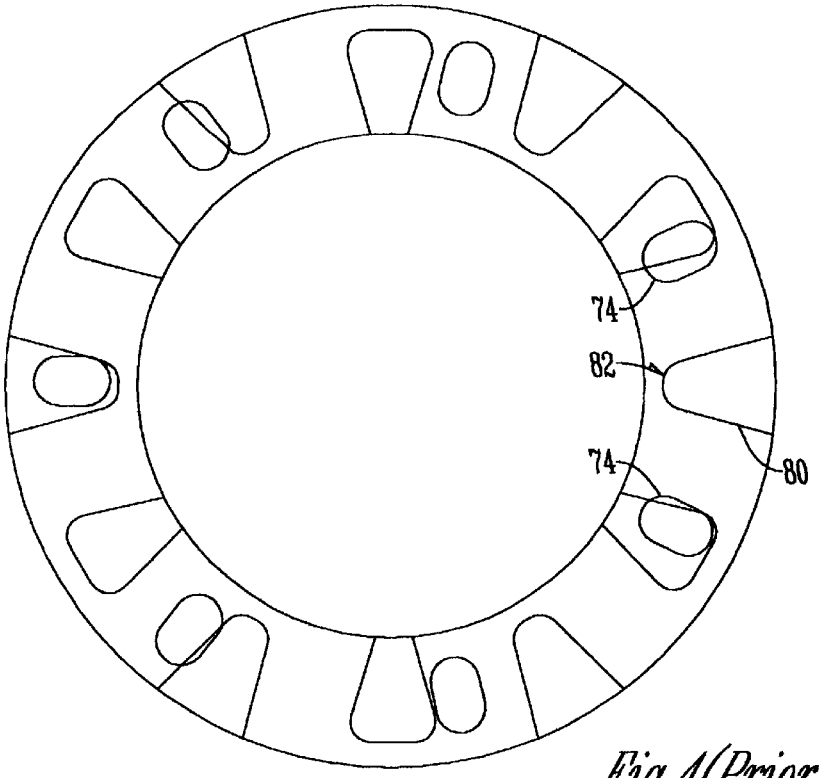
Fig. 4(Prior Art)
FIG. 4 is a view of a prior art device showing the commutating ports of a disc valve superimposed over the port plate ports.
Figure 6:
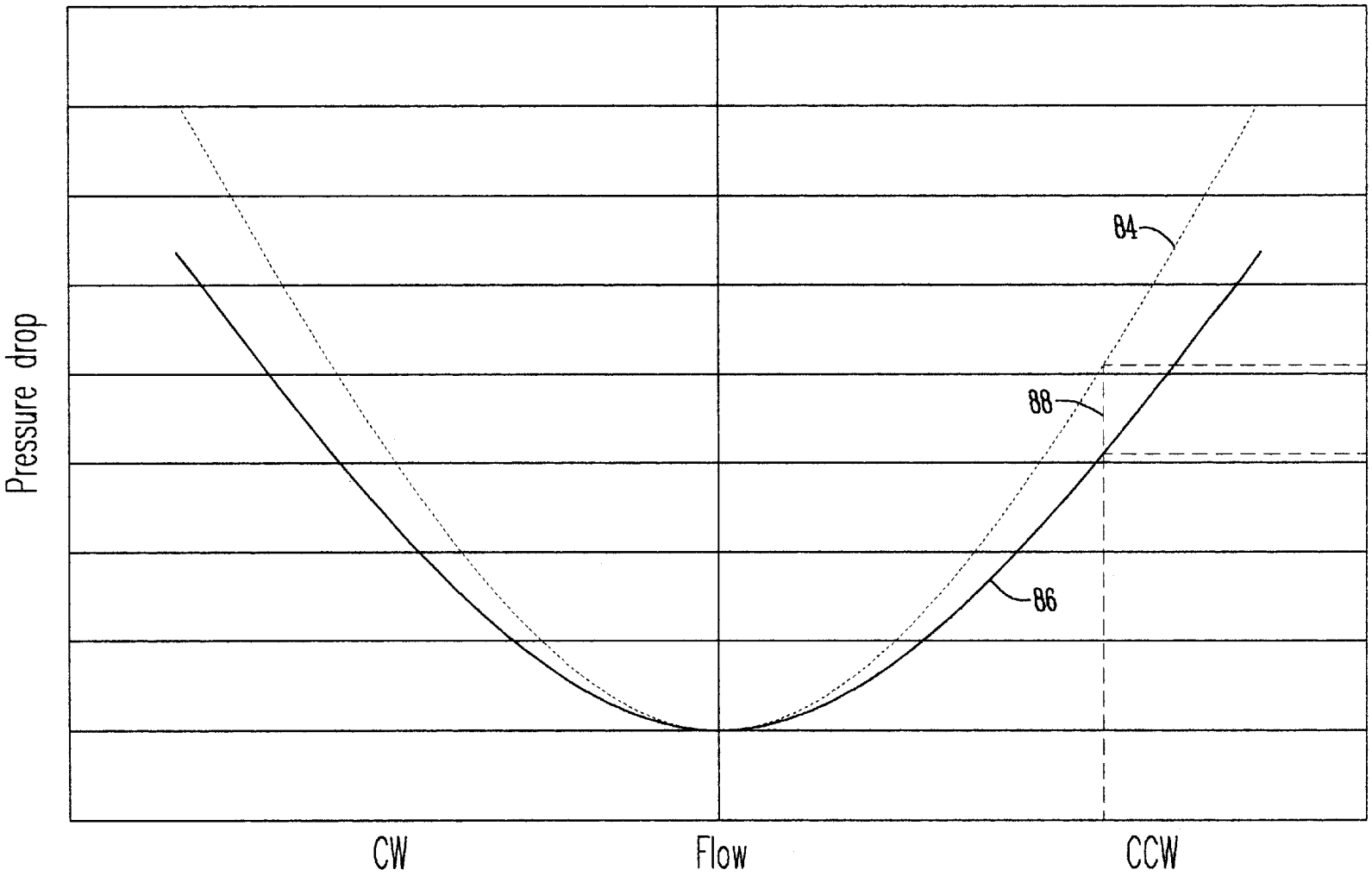
FIG. 6 is a graph showing pressure drop and flow charted in graph form displaying the resulting curves for this invention as compared to those of a prior device such as that shown in FIG. 4.

The advantage of the nesting effect described above is illustrated in FIG. 6 wherein the hydraulic pressure drop of the prior art device of FIG. 4 is charted against hydraulic flow to reflect curve 84 (dotted line in FIG. 6). The curve 86 illustrates the correspondingly decreased pressure drop accomplished by the nesting affect shown in FIGS. 5 and 7A. Thus, it is seen that the nesting effect, as described above when the ports 74 are in nesting position with the sides of slots 50 and 54 in the opening or closing moments of the ports (see numeral 90 in FIG. 5), creates a substantial advantage (see arrow 88) in the present invention insofar as reduction in the pressure drop illustrated by arrow 88 can be as much as 5.6 bar. The nesting phenomenon, as described above, provides less resistance to the flow of fluid, thus reducing the fluid pressure to cause a comparative drop in pressure at opening and closing moments of the ports as compared to the prior art system shown in FIG. 4.

It is thus seen that this invention will achieve at least all of its stated objectives.

We claim:

1. A hydraulic motor of the disc valve type wherein the disc valve has a surface engaging a surface of a port plate and wherein the surface on the disc valve has a plurality of commutating slots with arcuate sides that sequentially register with a plurality of oval-shaped ports on the surface of the port plate as the disc valve is rotated with respect to port plate, the improvement comprising, the commutating slots having arcuate sides that are complimentary in shape to the arcuate sides of the ports at opening and closing moments of the ports to reduce the resistance to fluid flow through the ports and the commutating slots when the sides of each register with each other in superimposed relation.

2. In a hydraulic motor of the disc valve type wherein the disc valve has a plurality of commutation slots that sequentially register with ports in a port plate as the disc valve is rotated with respect to the port plate, the improvement comprising, the commutating slots having sides with geometrical configuration having an arcuate portion that is complimentary in shape to the geometric configuration of the sides of the ports in the port plate such that the commutation slots and the port plate ports nest together at opening and closing moments of the ports to reduce the resistance to fluid flow through the ports and the slots when the complimentary shapes move into or from superimposed registering positions.

* * * * *